US005277014A

United States Patent [19]

White

[11] Patent Number: 5,277,014

[45] Date of Patent: Jan. 11, 1994

[54] BAG DISCHARGE STATION

[75] Inventor: Harold R. White, New Lenox, Ill.

[73] Assignee: ABR Corporation, New Lenox, Ill.

[21] Appl. No.: 944,408

[22] Filed: Sep. 14, 1992

[51] Int. Cl.[5] ..... B65B 43/26

[52] U.S. Cl. ..... 53/381.2; 414/412

[58] Field of Search ..... 53/492, 381.2, 384.1; 414/411, 412, 419

[56] References Cited

U.S. PATENT DOCUMENTS

| | | | |
|---|---|---|---|
| 3,467,267 | 9/1969 | Van Elten | 414/412 |
| 3,482,718 | 12/1969 | Moriarty | 414/412 |
| 3,680,725 | 8/1972 | Poulton | 414/412 |
| 3,948,402 | 4/1976 | Schott, Jr. | 414/412 |
| 4,034,877 | 7/1977 | Bennison | 414/412 |
| 4,289,438 | 9/1981 | Murer | 414/412 |
| 4,504,183 | 3/1985 | Bennison et al. | 53/381.2 X |
| 4,798,508 | 1/1989 | Lewis | 53/492 X |
| 5,056,980 | 10/1991 | Redl | 414/412 |

FOREIGN PATENT DOCUMENTS

| | | | |
|---|---|---|---|
| 2453542 | 5/1976 | Fed. Rep. of Germany | 414/412 |
| 2533194 | 3/1984 | France | 414/412 |
| 7612597 | 11/1976 | Netherlands | 414/412 |
| 8105283 | 6/1983 | Netherlands | 414/412 |
| 535190 | 11/1976 | U.S.S.R. | 414/412 |
| 662431 | 5/1979 | U.S.S.R. | 414/412 |
| 1402498 | 6/1988 | U.S.S.R. | 414/412 |
| 1479360 | 5/1989 | U.S.S.R. | 414/412 |
| 1202771 | 8/1970 | United Kingdom | 414/412 |
| 2040254 | 8/1980 | United Kingdom | 414/412 |
| 2137157 | 10/1984 | United Kingdom | 414/412 |
| 2138769 | 10/1984 | United Kingdom | 414/412 |

*Primary Examiner*—John Sipos
*Assistant Examiner*—Daniel Moon
*Attorney, Agent, or Firm*—Hill, Steadman & Simpson

[57] ABSTRACT

An apparatus for discharging the contents of bags containing flowable material includes a frame, with a pair of bag spikes mounted generally parallel to, and coplanar with, one another on the frame. A pair of bag pans is movably mounted on the frame so as to be engageable with the bag spikes. Each of the pans is selectively pivotable around a respective axis defined by each of the bag spikes. The bag pans are movable between a first, load/unload position wherein the bag pans are out of engagement with the spikes, and a second, engaged position wherein the bag pans are in engagement with the spikes. A knife assembly is provided that includes a knife arm having a first end pivotably mounted to the frame, and a second end upon which is disposed a knife member. The knife assembly is pivotable between a severing position wherein the knife member extends between the bag pans, and a rest position wherein the knife member is out of the plane defined by the bag pans. A bag pan drive mechanism is mounted on the frame, and is adapted to move the bag pans between their load/unload and engaged positions. A knife actuator mechanism is also mounted on the frame. The knife actuator mechanism is adapted to move the knife assembly between the severing position and the rest position. A bag pan pivot mechanism is also mounted on the frame, and is adapted to selectively pivot the bag pans about the axes defined by the bag spikes.

14 Claims, 4 Drawing Sheets

BAG DISCHARGE STATION

TECHNICAL FIELD

The present invention relates to apparatus for discharging the contents of bags containing flowable materials.

BACKGROUND OF THE INVENTION

Flowable materials, such as dry powders and granular materials, are used throughout the world. Such products are typically shipped and handled in bags containing 50 to 100 pounds of material. The bags are usually multilayer bags that provide strength, moisture resistance, and protection of product purity and integrity. It is often the case that the materials themselves are hazardous to human health and safety, posing the risk of burning and skin irritation on contact, respiratory aliments, and eye irritation. Some materials are carcinogenic with long term exposure.

The act of emptying or removing the material from these bags presents serious industrial problems in terms of manpower costs, personnel safety, hygiene, and product contamination. The physical act of emptying the bags requires manually lifting and placing the bags over a hopper or receiver, cutting the bags open with a knife or razor blade, dumping the contents and shaking the bag. This type of work results in cuts, strains, back injuries and exposure to material being handled. Pieces of the bag are often dropped into the material causing contamination of the product. Previous efforts to solve or alleviate the problems associated with emptying bags of flowable material rely on training of personnel, extensive use of personal safety equipment, local and area ventilation, work area clean up and decontamination.

As can be seen from the foregoing, it is clear that the need exists for a simple, economical, and environmentally safe apparatus for handling and removing flowable materials from bags.

SUMMARY OF THE INVENTION

The present invention overcomes the disadvantages of known methods and apparatus by providing a simple, economical, and environmentally safe method and apparatus for removing flowable material from a bag. In an illustrative embodiment, the apparatus includes a frame, with a pair of bag spikes mounted generally parallel to, and coplanar with, one another on the frame. A pair of bag pans is movably mounted on the frame so as to be engageable with the bag spikes. Each of the pans is selectively pivotable around a respective axis defined by each of the bag spikes. The bag pans are movable between a first, load/unload position wherein the bag pans are out of engagement with the spikes, and a second, engaged position wherein the bag pans are in engagement with the spikes. A knife assembly is provided that includes a knife arm having a first end pivotably mounted to the frame, and a second end upon which is disposed a knife member. The knife assembly is pivotable between a severing position wherein the knife member extends between the bag pans, and a rest position wherein the knife member is out of the plane defined by the bag pans. A bag pan drive mechanism is mounted on the frame, and is adapted to move the bag pans between their load/unload and engaged positions. A knife actuator mechanism is also mounted on the frame. The knife actuator mechanism is adapted to move the knife assembly between the severing position and the rest position. A bag pan pivot mechanism is also mounted on the frame, and is adapted to selectively pivot the bag pans about the axes defined by the bag spikes.

The bag pan drive mechanism includes a pair of drive screws, each of which is associated with and connected to a respective bag pan. A motor is connected in a driving engagement with the drive screws.

The knife actuator mechanism includes a double acting cylinder having a first end secured to the frame and a second end secured to the knife arm.

The bag pan pivot mechanism can include a pair of annular cylindrical rod casements. Each of the rod casements rotatably concentrically surrounds a respective one of the bag spikes, and has a terminal end rigidly secured to one of the bag pans. A pair of selectively actuable pan tilt cylinders are provided, each of which has a first end secured to the frame, and a second end secured to one of the rod casements. The pivot mechanism pivots severed halves of the bag so that their open ends face downwardly, in order to empty the contents of the bag.

A dust enclosure can be provided that is mountable on the frame so as to enclose the bag pans when they are in their engaged position. The dust enclosure can include a vent adapted for connection to a dust collector, and a selectively openable bag pan door. The dust enclosure can also include a discharge opening at a lower end thereof.

A vibrator mechanism can be provided that is operatively connected to the bag pans to enhance discharge of flowable material from the bags. A compactor assembly can also be provided, mounted on the frame in proximity with the bag pans when they are in their load/unload position. The compactor assembly is provided to compact the bag halves after material has been discharged. Once the bags have been compressed, the bag pans can be again pivoted downwardly, after which the compactor can be used to compress the empty bags into a disposal container.

The present invention also provides a method for discharging the contents of a bag containing flowable material. The method includes the steps of penetrating opposite edges of the bag with respective bag spikes, severing the bag into two bag sections while the bag spikes remain in the opposite edges of the bag, and pivoting the bag sections about the bag spikes to discharge the contents of the bag. The method can also include the steps of vibrating the bag sections to enhance discharge of the contents of the bag, and/or compacting the bags after the contents have been discharged. The bags are discarded after they have been compacted.

The method and apparatus of the present invention provide a rugged design to withstand such abuse as bags being placed, thrown, dropped, or jammed into the apparatus.

The present invention also provides flexible operation. The bags are not always flat, smooth, dry, wrinkle-free, and properly centered when placed in the bag pan. The present invention accommodates most of the variations encountered in use, and rejects only those bags that would cause a malfunction, such as a jam, that would damage the apparatus.

The present invention also provides a dust containment mechanism that collects and contains all of the dust that is generated during normal, or even abnormal, operation. A control system may be provided to ensure that the containment system is functional before the apparatus is operated.

The present invention takes into consideration the safety of personnel operating the apparatus. All sharp edges, points, and moving parts are designed with the utmost concern for the safety of the operator during maintenance, normal, and abnormal operation of the system.

The present invention provides a controlled discharge of material from the bag, so that the material does not dump all at once, which causes problems with dispersion, dust, mixing, and impact. The bags are emptied as effectively and completely as possible, equaling or exceeding the performance that can be achieved by performing the same function manually.

The apparatus is capable of operating in a fully automatic mode, accepting bags from a conveyor on a continuous basis without constant attention from a machine operator.

Other objects and advantages of the present invention will be apparent with reference to the accompanying description taken in conjunction with the drawings.

DETAILED DESCRIPTION OF THE PREFERRED EMBODIMENT

Figure 1:
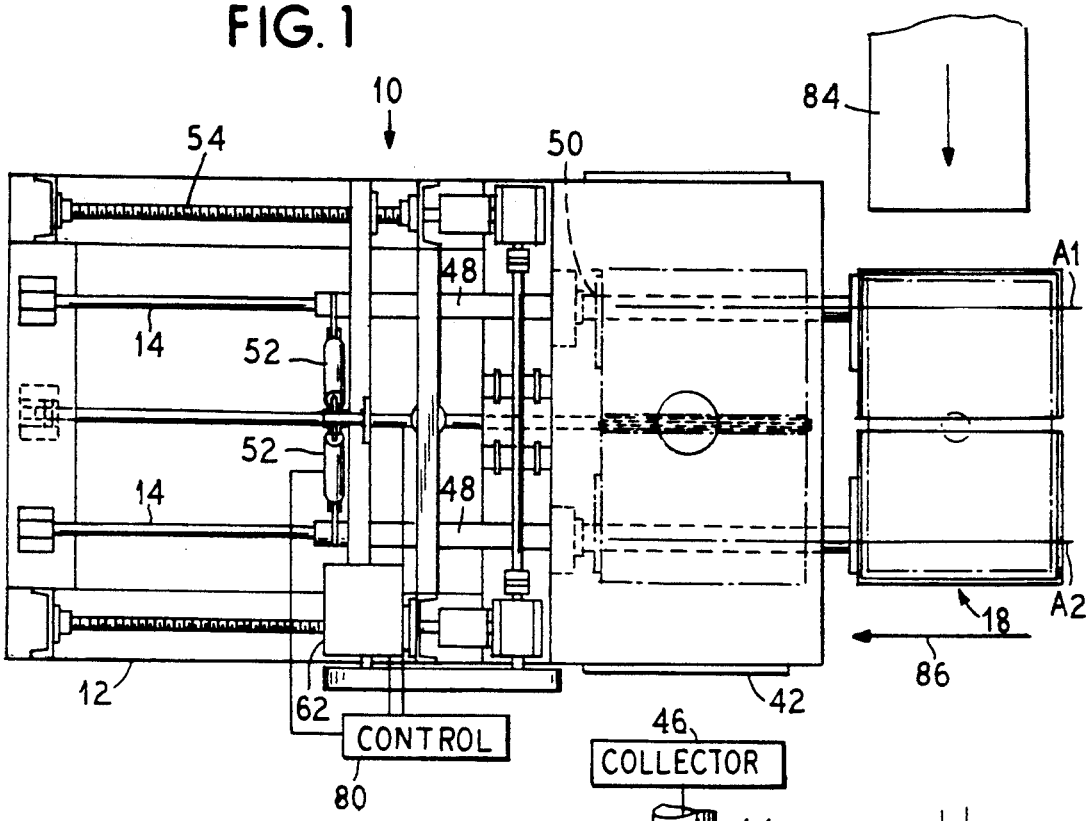
FIG. 1 illustrates a plan view of an apparatus embodying the principles of the present invention, with the bag pans in the load/unload position.
Figure 2:
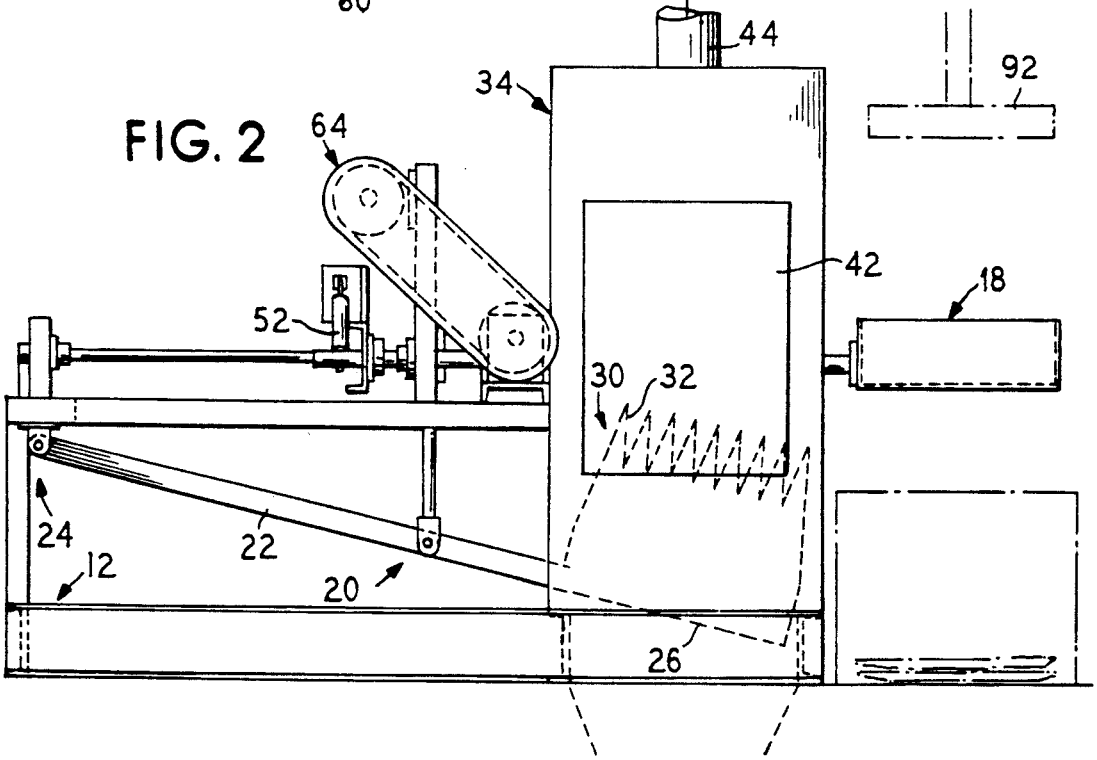
FIG. 2 illustrates a side view of the apparatus shown in FIG. 1.
Figure 3:
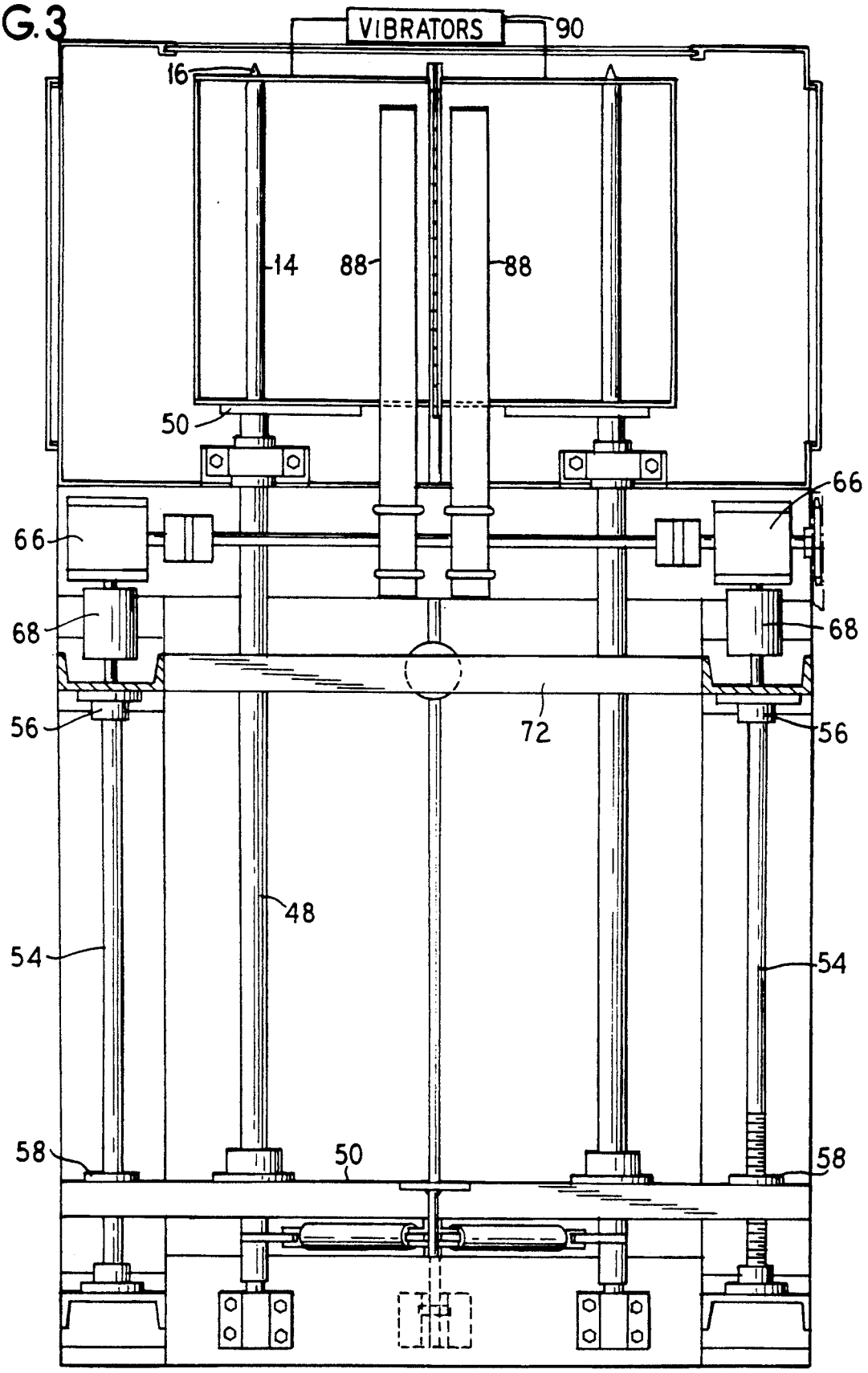
FIG. 3 illustrates a sectional view of the FIG. 1 embodiment, with the bag pans in their engaged position.

FIGS. 1 through 3 illustrate an apparatus 10 for removing flowable material from a bag. The apparatus 10 includes a frame 12, with a pair of bag spikes 14 mounted generally parallel to, and coplanar with, one another on the frame 12. The bag spikes 14 are stationary with respect to the frame, and include pointed ends 16 adapted to penetrate opposite edges of a bag of flowable material.

A pair of bag pans 18 is movably mounted on the frame 12 so as to be individually engageable with the bags spikes 14. Each of the bag pans 18 is selectively pivotable about a respective axis A1, A2 defined by each of the bags spikes 14. The bag pans 18 are horizontally movable between a first load/unload position (FIGS. 1 and 2) wherein the bag pans 18 are out of engagement with the bag spikes 14, and a second, engaged position (FIGS. 3 and 4) wherein the bag pans 18 are in engagement with the bag spikes 14. The drive and pivot mechanisms for the bag pans 18 will be described in detailed herein below.

A knife assembly 20 is provided, and includes a knife arm 22 having a first end 24 pivotably mounted to the frame 12. The knife arm 22 also includes a second end 26 upon which is disposed a knife member 30 including a plurality of knife blades 32. The knife assembly 20 is pivotable between a severing position (shown in solid line in FIG. 4), in which the knife member 30 extends between the bag pans 18, and a rest position (shown in phantom in FIG. 4) wherein the knife member 30 is out of a plane defined by the bag pans 18. The knife actuator mechanism will be described in detail herein below.

Figure 4:
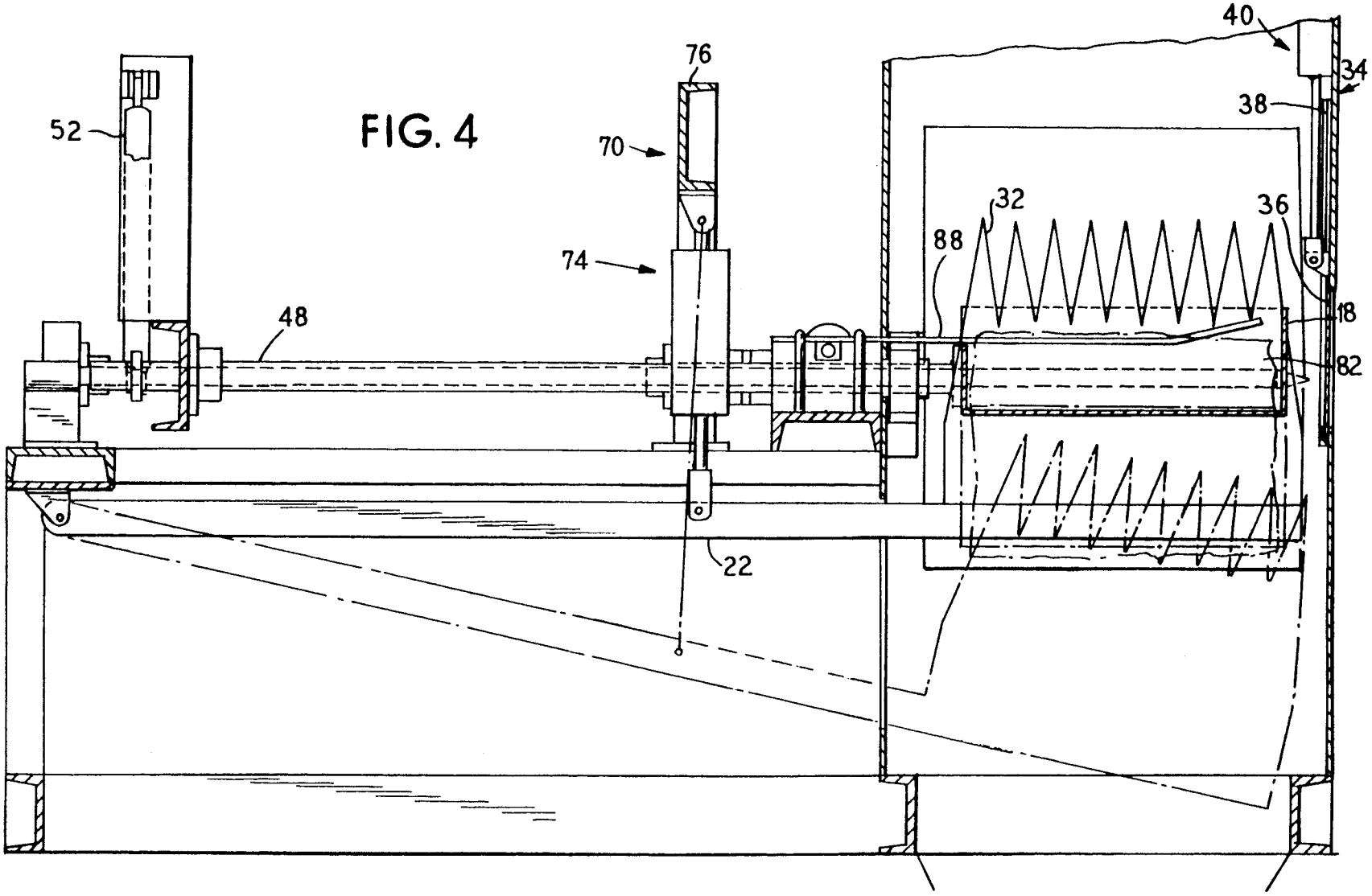
FIG. 4 illustrates a detailed sectional view of the apparatus shown in FIGS. 1 through 3, with the bag pans in their engaged position.
Figure 6:
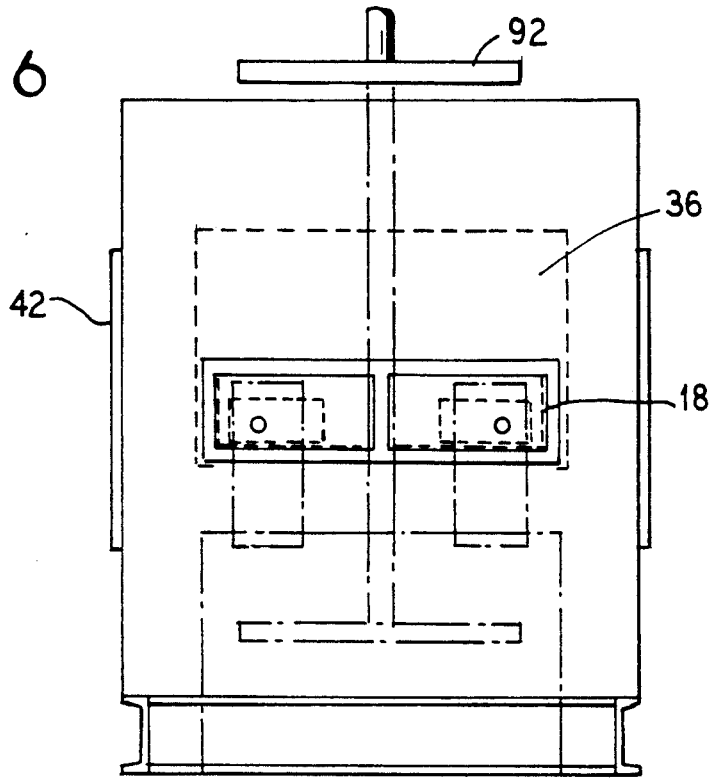
FIG. 6 illustrates a sectional view of this front elevational view of the dust enclosure, showing the pans in their discharge position.
Figure 5:
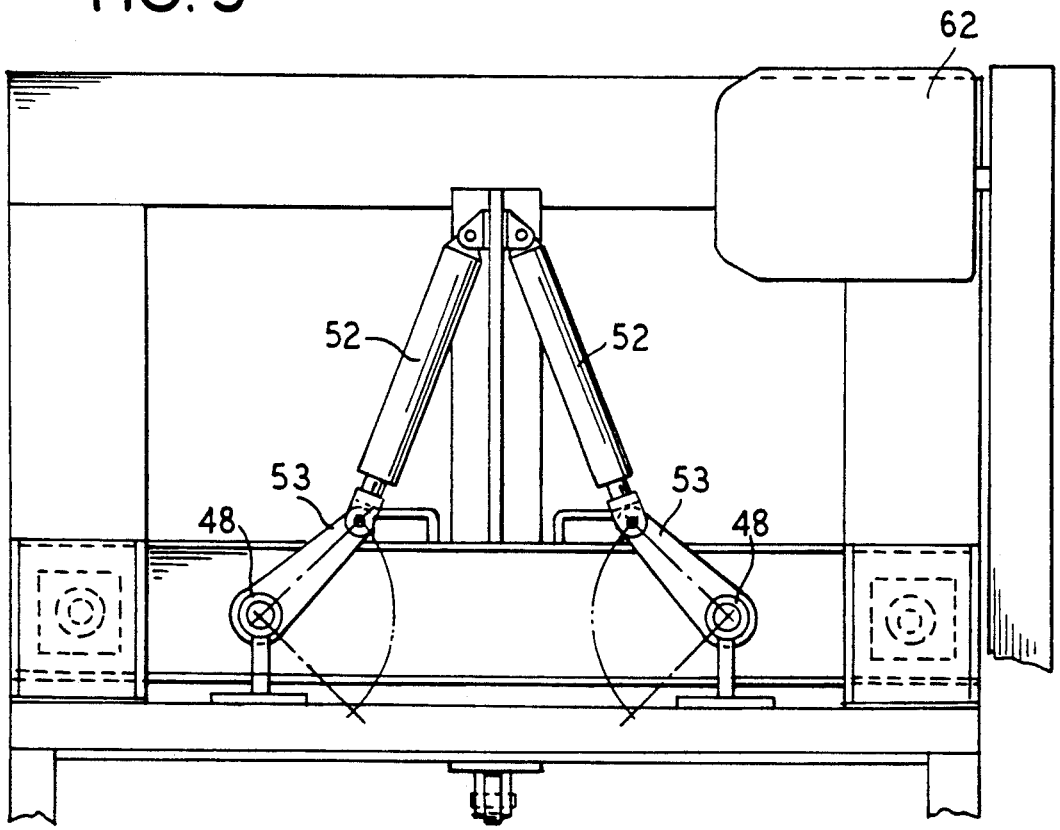
FIG. 5 illustrates a sectional view of the pan rotating mechanism partially broken away, taken generally along line V—V of FIG. 1.

A dust enclosure 34 is mounted on the frame 12 so as to enclose the bag pans 18 when they are in their engaged and discharge position. The dust enclosure 34 includes a bag pan door 36 (FIG. 4). The bag pan door 36 is guided by brackets 38 to slide between open and closed positions. The bag pan door 36 is actuated by a bag pan door actuator 40, shown here as, for example, an hydraulic cylinder and piston arrangement. It is to be understood that the sliding door and actuator configuration for the bag pan door 36 is merely illustrative, and that other arrangement, for example, dual sliding doors or swing doors, could be used.

The dust enclosure 34 also includes an access door 42, which may be used to gain access to the interior of the dust enclosure 34 for maintenance or service. The dust enclosure 34 includes a vent 44 that is adapted for connection to a dust collector 46. The dust collector 46 can, for example, include dust filters or other particulate collection apparatus.

The mechanism by which the bag pans 18 are pivoted includes a pair of annular cylindrical rod casements 48 (FIGS. 1, 3, 4 and 5) that rotatably concentrically surround the respective bag spikes 14. Each of the casements 48 has a first end rotatably secured to a carriage bracket 50 and a terminal end that is rigidly secured to a respective one of the bag pans 18. Each of the rod casements 48 is connected to a respective pan tilt cylinder 52 via a connecting member 53. The pan tilt cylinders can, for example, be provided as hydraulically actuable cylinder and rod assemblies.

A pan drive mechanism is provided to move the bag pans between their load/unload and engaged positions. The bag pan drive mechanism includes a pair of drive screws 54. Each of the drive screws 54 is rotatively secured to the frame 12 of the apparatus 10 via a pair of flanged bearings 56. Each of the drive screws 54 passes through a flanged ball nut 58 mounted on the horizontal carriage bracket 50, which spans the apparatus. The rod casements 48, as well as the pan tilt mechanism, are secured to, and travel along with, the carriage bracket 50. The drive screws 54 are rotated by a drive motor 62 that is coupled to the drive screws 54 via a belt and pulley assembly 64, gear reducers 66, and couplings 68.

A knife actuator mechanism, indicated generally at 70, is mounted on a stationary bracket 72 spanning the frame 12 of the apparatus 10. As illustrated, the knife actuator mechanism 70 includes a double-acting cylinder 74 having a first end pivotably mounted to an overhead bracket 76. A second end of the cylinder assembly 74 is pivotably mounted to the knife arm 22. The knife cylinder 74, for example, a double acting hydraulic cylinder, is hydraulically actuable to move the knife assembly 20 between its rest and severing positions.

The actuator mechanisms for moving and tilting the pans, for opening and closing the bag pan door, and for actuating the knife assembly can be centrally controlled via a control system 80, for example, a microprocessor control system.

Operation of the apparatus 10 is as follows. With the bag pans 18 in their load/unload position, a bag 82 containing flowable material is placed into the bag pans 18, for example, by a conveyor 84. It is also contemplated that the bag 82 could be manually placed into the bag pans, since, at this juncture the bags are closed and pose a reduced contamination hazard. Once the bag 82 has been placed into the bag pans 18, the bag pans may be drawn through the open bag pan door 36 into the dust enclosure 34. This is accomplished by actuating the drive motor 62 to rotate the drive screws 54, which interact with the flanged ball nuts 58 on the carriage bracket 50 to move the carriage bracket, along with the rod casement and bag pans, in the direction of arrow 86 in FIG. 1. As the bag pans 18 move into the dust enclosure 34, the spikes 14 pierce the bag 82 adjacent to its opposite ends. Once the bag pans 18 reach the engaged position (indicated in phantom line in FIG. 1, and shown in FIGS. 3 and 4), the bag pan door 36 can be closed, and the knife actuator 70 can be used to bring the knife assembly 20 from its rest position into its severing position. Movement of the knife assembly 20 into the severing position causes the knife blades 32 to puncture and bisect the bag 82 into separate bag halves, which are held in place by a pair of leaf springs 88. With the bag 82 severed into separate bag halves, the actuator 70 can then be used to return the knife assembly 20 to its rest position.

With the bag cut in half and the knife assembly in its rest position, the pan tilt cylinders 52 are actuated to pivot the bag pans 18 downwardly. The bag halves pivot about the bag spikes 18, and the flowable material in the bag 82 is then discharged by gravity. Alternatively, vibrators 90 may be attached to the pans to enhance discharge rate. The rate of discharge may also be controlled by selectively rotating the pans one at a time, and by selectively controlling the rotational speed downward pivot of the bag pans 18.

After the bag 82 has been emptied, the bag pans 18 are returned to their original horizontal positions within the dust enclosure 34. The bag pan door 36 is opened, and the bag pans 18 are returned to their load/unload position. A compactor 92 is then driven downwardly while the bag pans 18 are in the horizontal position to flatten the now-empty bag halves. The bag pans 18 are then again rotated downwardly and the compactor 92 resumes its downward movement, thus further compressing the empty bag into a disposal container, for example, a dumpster, positioned below the bag pans 18. The compactor 92 is then raised to its midpoint position, the bag pans 18 are rotated to their horizontal position. The compactor is raised to its standby position and the cycle may be repeated.

It is to be understood that the foregoing example is merely illustrative, and that various modifications will become immediately apparent to those of ordinary skill in the art. For example, appropriate instrumentation such as proximity switches, timers, motor controls, lights, and the specific logic control for the central computer control system could be provided to insure safe and automatic operation of the apparatus 10.

Although the present invention has been described with reference to a specific embodiment, those of skill in the art will recognize that changes may be made thereto without departing from the scope and spirit of the invention as set forth in the appended claims.

I claim as my invention:

1. An apparatus for discharging contents of a bag, said apparatus comprising:

bag engaging means including first and second horizontally directed spikes and means for mounting said spikes in fixed, stationary positions;

first and second bag pans and means for moving said bag pans horizontally relative to said first and second horizontally directed spikes between a bag loading position and an engaged position, said bag pans lying below respective ones of said first and second horizontally directed spikes when in said engaged position so that horizontal movement of said first and second bag pans with a bag positioned thereon to said engaged position causes the bag to be impaled on said first and second horizontally directed spikes;

cutting means for severing the bag into two bag sections, said cutting means including a knife blade, a lever on which said knife blade is mounted, means for moving said lever to a position placing said knife blade between said first and second bag pans from below so that a bag lying on said bag pans is cut open; and pivot means for pivoting said bag pans about said spikes from a substantially horizontal orientation to a substantially vertical orientation to discharge the contents of the bag from a cut made by said knife blade.

2. An apparatus according to claim 1, wherein said first and second horizontally directed spikes penetrate opposite sides of said bag when said bag pans are in said engaged position to provide respective pivot axes for said two bag sections as said pivot means pivots said bag pans.

3. An apparatus as claimed in claim 1, further comprising:

leaf springs stationarily positioned to engage a top surface of the bag when said first and second bag pans are in said engaged position and as said knife blade cuts the bag.

4. An apparatus for discharging the contents of a bag, said apparatus comprising:

a frame;

a pair of bag spikes and means for mounting said spikes generally parallel to, and coplanar with, one another on said frame in fixed, stationary positions;

a pair of bag pans horizontally movably mounted on said frame so as to be engageable with said bag spikes, each of said pans being selectively pivotable about a respective axis defined by said bag spikes, means for moving said bag pans between a first, bag load/unload position wherein said bag pans are out of engagement with said spikes and a second, engaged position wherein said bag pans are in engagement with said spikes and said spikes penetrate a bag positioned on said bag pans;

a knife assembly including a knife arm having a first end pivotably mounted to said frame and a second end upon which is disposed a knife member, said knife assembly being pivotable between a severing position wherein said knife member extends between said bag pans, and a rest position wherein said knife member is out of a space defined between said bag pans;

a bag pan drive mechanism mounted on said frame, said bag pan drive mechanism being adapted to move said bag pans between said load/unload and engaged positions;

a knife actuator mechanism mounted on said frame, said knife actuator mechanism being adapted to move said knife assembly between said severing position and said rest position; and a bag pan pivot mechanism mounted on said frame, said bag pan pivot mechanism being adapted to selectively pivot said bag pans about said axes defined by said bag spikes.

5. An apparatus according to claim 4, wherein said bag pan drive mechanism comprises:

a pair of drive screws, each of said drive screws being associated with and connected to one of said bag pans; and a motor connected in driving engagement to said drive screws for selective driving rotation of said pair of drive screws.

6. An apparatus according to claim 4, wherein said knife actuator mechanism comprises a selectively actuable double acting cylinder having a first end secured to said frame and a second end secured to said knife arm.

7. An apparatus according to claim 4, wherein said bag pan pivot mechanism comprises:

a pair of annular cylindrical rod casements, each of said casements rotatably concentrically surrounding a respective one of said bag spikes and having a terminal end rigidly secured to a respective one of said bag pans; and a pair of selectively actuable pan tilt cylinders, each of said pan tilt cylinders having a first end secured to said frame and a second end secured to one of said rod casements.

8. An apparatus according to claim 4, further comprising a vibrator mechanism operatively connected to said bag pans.

9. An apparatus according to claim 4, further comprising a compactor assembly mounted on said frame in proximity with said load/unload position of said bag pans, said compactor assembly being adapted to compact bags after the contents have been discharged.

10. An apparatus as claimed in claim 4, further comprising:

a pair of leaf springs mounted stationarily on said frame in a position above respective ones of said pair of bag pans when said pair of bag pans is in said engaged position so as to engage a top surface of the bag when said knife cuts the bag, said pair of leaf springs being spaced apart a distance to permit said knife member to extend therebetween.

11. An apparatus according to claim 4, further comprising a dust enclosure mounted on said frame so as to enclose said bag pans when said bag pans are in said engaged position.

12. An apparatus according to claim 11, wherein said dust enclosure includes a discharge opening at a lower end thereof.

13. An apparatus according to claim 11, wherein said dust enclosure includes a vent adapted for connection to a dust collector.

14. An apparatus according to claim 11, wherein said dust enclosure includes a selectively openable bag pan door.

* * * * *